United States Patent [19]

Yahata et al.

[11] Patent Number: 4,734,924

[45] Date of Patent: Mar. 29, 1988

[54] X-RAY GENERATOR USING TETRODE TUBES AS SWITCHING ELEMENTS

[75] Inventors: Mitsuru Yahata; Hidetoshi Kudo, both of Ootawara, Japan

[73] Assignee: Kabushiki Kaisha Toshiba, Kawasaki, Japan

[21] Appl. No.: 917,078

[22] Filed: Oct. 8, 1986

[30] Foreign Application Priority Data

Oct. 15, 1985 [JP] Japan ..... 60-227692
Oct. 23, 1985 [JP] Japan ..... 60-235277

[51] Int. Cl.[4] ..... H05G 01/26; H05G 01/54

[52] U.S. Cl. ..... 378/118; 315/107; 361/87; 378/114

[58] Field of Search ..... 378/117, 118, 110, 112, 378/114; 328/082; 315/106, 107; 361/087

[56] References Cited

U.S. PATENT DOCUMENTS 2,173,315 9/1939 Schuttig ..... 328/082
4,402,086 8/1983 Setbon ..... 378/112
4,520,495 5/1985 Tanaka ..... 378/117

*Primary Examiner*—Craig E. Church
*Assistant Examiner*—T. N. Grigsby
*Attorney, Agent, or Firm*—Finnegan, Henderson, Farabow, Garrett & Dunner

[57] ABSTRACT

The anode and cathode of an X-ray tube are connected to a high-voltage power source respectively, through corresponding tetrode tubes, and the center metal electrode of the X-ray tube is grounded. The tetrode tubes are simultaneously turned on and off upon receipt of a control signal. An abnormal current, which flows through the center metal electrode due to a short-circuiting fault of the tetrode tube connected to the cathode of the X-ray tube, is detected during an OFF period of the tetrode tubes. Upon detection of the abnormal current, the tetrode tube connected to the anode of the X-ray tube is forcedly turned on, thus preventing the fusion of the center metal electrode in the X-ray tube.

5 Claims, 8 Drawing Figures

X-RAY GENERATOR USING TETRODE TUBES AS SWITCHING ELEMENTS

BACKGROUND OF THE INVENTION

This invention relates to an X-ray generator using tetrode tubes as switching elements for an X-ray tube of a center metal-grounded type.

In the X-ray generator of this type, a high-tension power source is connected to the anode and cathode of an X-ray tube respectively, through switching elements (for example, tetrode tubes), with the center metal electrode of the X-ray tube grounded, and X-rays are generated by applying a high voltage across the anode and center metal, and across the cathode and center metal.

When, in this arrangement, a high voltage is supplied to the cathode, not the anode, due to, for example, a breakage of a cable on the anode side while the filament of the X-ray tube is heated, there is a risk that the X-ray tube will be broken, due to an abnormal current flowing between the cathode and center metal electrode of the X-ray tube.

Japanese patent laid-open publication No. 56-94800 discloses the concept of detecting an abnormal current in the cathode, to stop the projection of X-rays. According to this prior art, if an abnormal current flows due to a switch, on the cathode side of an X-ray tube, being not opened on account of a short-circuiting fault, this is detected by an abnormal-current detection circuit, in which case an interlock circuit issues an X-ray-stopping instruction to an X-ray control circuit, in order to protect the X-ray tube. That is, the conventional protection means functions to cut a high-tension power source and heater power source of the X-ray tube and thus to cease the supply of a voltage to the X-ray tube. As such a high-tension power source, a type is known which includes rectifying circuits. In such rectifying circuits for converting an AC voltage supplied from an AC power source, through a high-tension transformer, to high DC voltages, smoothing capacitors following rectifiers are required. To prevent X-ray projection or irradiation from the X-ray tube, in the event of a short-circuiting fault of a cathode-side switch, a high-tension switch on the anode side, as well as a switch on the AC power source side, is opened subsequent to the detection of an abnormal current. Since, however, the smoothing capacitors are already charged by the AC power source, a current flows from the capacitor, through the switch, into a cathode-to-center metal electrode path of the X-ray tube. Since a current flowing through the center metal electrode at an abnormal time is much greater than a current flowing at a normal X-ray projection time, there is a risk that the X-ray tube will be broken, due to the fusion of the center metal electrode.

SUMMARY OF THE INVENTION

An object of this invention is to provide an improved X-ray generator whose X-ray tube is protected from a possible abnormal current in the X-ray tube.

Another object of this invention is to provide an X-ray generator whose X-ray tube having a grounded center metal electrode is protected from a possible abnormal current flowing through a cathode-to-center metal path in the X-ray tube.

According to this invention, during the OFF periods of first and second switching means for supplying positive and negative high voltages to the anode and cathode of the X-ray tube in a cyclic fashion, an abnormal-current detection circuit means produces a second switching-means short-circuiting-fault detection signal, in response to an abnormal current flowing through the center metal electrode due to a short-circuiting fault of the second switching means connected to the cathode of the X-ray tube. A means is provided which forcedly turns on at least the first switching means, in response to the second switching-means short-circuiting-fault detection signal from the abnormal-current detection means.

DETAILED DESCRIPTION OF THE PREFERRED EMBODIMENT

Figure 1:
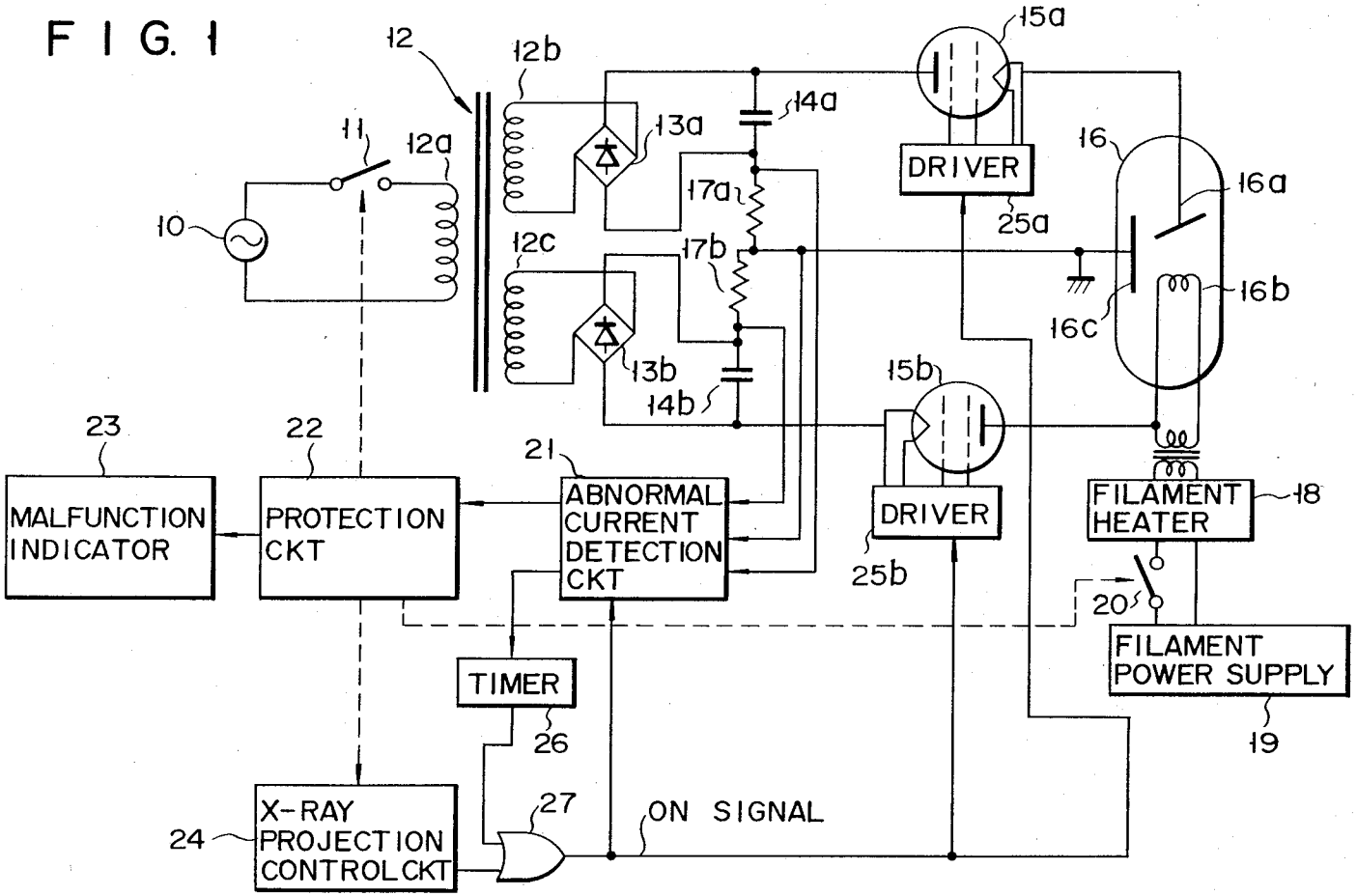
FIG. 1 is a circuit arrangement of an X-ray generator according to a first embodiment of this invention.

In FIG. 1, AC power source 10 for supplying, for example, 200 V, is conneoted to primary winding 12*a* of high-tension transformer 12, via power source switch 11. Transformer 12 is comprised of secondary windings 12*b* and 12*c* of the same number of turns. Secondary windings 12*a* and 12*c* of the transformer are coupled to diode bridge circuits 13*a* and 13*b*, respectively, so as to apply a high voltage of the same level. The applied voltage is rectified by bridge circuits 13*a* and 13*b*. The outputs of diode bridges 13*a* and 13*b* are connected to capacitors 14*a* and 14*b*, respectively, to allow currents from bridges 13*a* and 13*b* to be smoothed. Capacitors 14*a* and 14*b* are connected, at one terminal, to anode 16*a* and cathode 16*b* in X-ray tube 16, respectively, via high-tension switches (tetrodes) 15*a* and 15*b*. Capacitors 14*a* and 14*b* are connected, at the other terminal, to ground respectively through resistors 17*a* and 17*b*. A high-tension voltage is applied to X-ray tube 16, to emit X-rays. Cathode 16*b* of X-ray tube 16 is preheated by filament heater 18, to increase the emission of electrons. Filament heater 18 is supplied with a power supply voltage from filament power supply via filament switch 20. Center metal electrode 16*c* of X-ray tube 16 is grounded to absorb recoil electrons.

The detection of an abnormal current at the anode and cathode sides of X-ray tube 16 is accomplished by measuring voltages across resistors 17*a* and 17*b* by abnormal current detection circuit 21, which is connected to resistors 17*a* and 17*b*. In an abnormal state, such as a fault of the tetrode tube (switch) and a short-circuiting failure of the high-tension switch on the cathode side, an abnormal current flows, which results in a noncoincidence between the voltages across resistors 17*a* and 17*b*. Upon occurrence of the abnormal state, detection circuit 21 promptly sends an abnormal-state signal to protection circuit 22 which immediately opens power source switch 11 and filament switch 20, to prevent an X-ray projection. Protection circuit 22 sends the abnormal-state signal to malfunction indicator 23 and X-ray projection control 24. Malfunction indicator 23 informs an operator or doctor of the abnormal state, by way of the abnormal-state signal.

X-ray projection control 24 simultaneously supplies a projection control signal (hereinafter referred to as an ON signal) to high-tension switch drivers 25*a* and 25*b*, so as to simultaneously turn tetrode tubes 15*a* and 15*b* on and off. Upon receipt of the abnormal signal from protection circuit 22, control circuit 24 stops the generation of the ON signal.

According to this invention, abnormal-current detection circuit 21 produces an abnormal-detection signal representing a short-circuiting failure of tetrode tube 15*b* connected to cathode 16*b* in the X-ray tube. This signal is supplied to timer 26 which produces a forced-ON signal with a predetermined duration time. The forced-ON signal, together with the output of control circuit 24, is coupled through OR gate 27 to high-tension switch drivers 25*a* and 25*b*. As a result, tetrode tube 15*a* on the anode side is forcedly turned ON. Since, in this way, two capacitors 1*a* and 1*b* are discharged between anode 16*a* and cathode 16*b* of X-ray tube 16, almost no current flows through center metal electrode 16*c*, thus preventing the fusion of center metal electrode 16*c* and a consequent breakage of the X-ray tube.

The arrangement of abnormal-current detection circuit 21 will be explained below, with reference to FIG. 2.

A connection point of capacitor 14*a* and resistor 17*a* is connected to an inverting input of an inverting amplifier 31*a*, and an output of the inverting amplifier 31*a* is connected to a noninverting input of comparator 33*a*. A connection point of capacitor 14*b* and resistor 17*b* is connected to an inverting input of inverting amplifier 31*b*, and an output of inverting amplifier 31*b* is coupled to an inverting input of inverting amplifier 32. An output of inverting amplifier 32 is coupled to a noninverting input of comparator 33*b*. The inverting inputs of comparators 33*a* and 33*b* are coupled to reference voltage source 34.

With tetrode tubes 15*a* and 16*b* in the conductive state, a voltage signal of a negative polarity is derived from resistor 17*a* and, conversely, a voltage signal of a positive polarity is derived from resistor 17*b*, noting that these voltage signals have a substantially equal magnitude when the circuit is in a normal operation state. The magnitudes of these voltages are compared, by comparators 33*a* and 33*b*, with the reference voltage Vref. Comparators 33*a* and 33*b* produce an output signal of a positive polarity during the normal operation of the tetrode tube, that is, when a normal current flows through the X-ray tube.

The output of comparator 33*a* is connected via inverter 35 to the input of AND gate 36*a*, and the output of comparator 33*b* is connected to an input of AND gate 36*b*.

The ON signal of X-ray projection control 24 is supplied to delay circuit 37*a* and through inverter 39 to delay circuit 38*b*. Delay circuits 37*a* and 37*b* provide delay times td1 and td2 to their output pulse signals, respectively. An X-ray tube current is delayed relative to the ON signal, thus preventing a possible detection error due to the delay of that current. The outputs of delay circuits 37*a* and 38*b* are coupled to the inputs of AND gates 36*a* and 36*b*, respectively. The outputs of AND gates 36*a* and 36*b* are connected to the set inputs of flip-flops 40*a* and 40*b*, respectively.

X-ray projection control 24 supplies a control signal of the same polarity as that of the ON signal, to AND gate 36*a*, and a control signal of an opposite polarity, to AND gate 36*b*. When, therefore, a normal current flows through X-ray tube 16, the output of AND gate 36*a* stays low. The same thing is also true in connection with AND gate 36*a*. Thus, flip-flop circuits 40*a* and 40*b* are not set, so that their outputs Q stay low.

When a fault occurs whereby, with the ON signal at a high level, tetrode tube 15*a* is turned off and tetrode tube 15*b* is turned on, the output of comparator 33*a* goes low and thus, the output of AND gate 36*a* goes high, thereby setting flip-flop 40*a*, with the result that the output of the flip-flop goes high. This signal is supplied via OR gate 41 to protection circuit 22, turning off switch 11 and filament switch 20. At the same time, protection circuit 22 informs the operator of the fault state, by way of malfunction indicator 23, while causing X-ray projection control to stop the generation of the ON signal.

When a fault occurs whereby, with the ON signal in the low state, tetrode tube 15*a* is turned off and tetrode tube 15*b* is turned on, the output of AND gate 36*a* stays low and thus, the output of AND gate 36*b* goes high, thereby setting flip-flop circuit 40*b*, so that an output Q of flip-flop circuit 40*b* goes high. The high-level output signal of flip-flop circuit 40*b* is supplied via OR gate 41 to protection circuit 22. In this way, a similar operation as set out above is performed. A high-level output signal of flip-flop circuit 40*b* is supplied to timer 26. Timer 26 prepares the forced ON signal, which is supplied through OR gate 27 to high-tension drivers 25*a* and 25*b*. As a result, the tetrode tube is forcedly turned on.

The reset inputs of flip-flops 40*a* and 40*b* are connected to reset switches 42*a* and 42*b*, respectively, so that the operator can reset these flip-flops as required.

Figure 3:
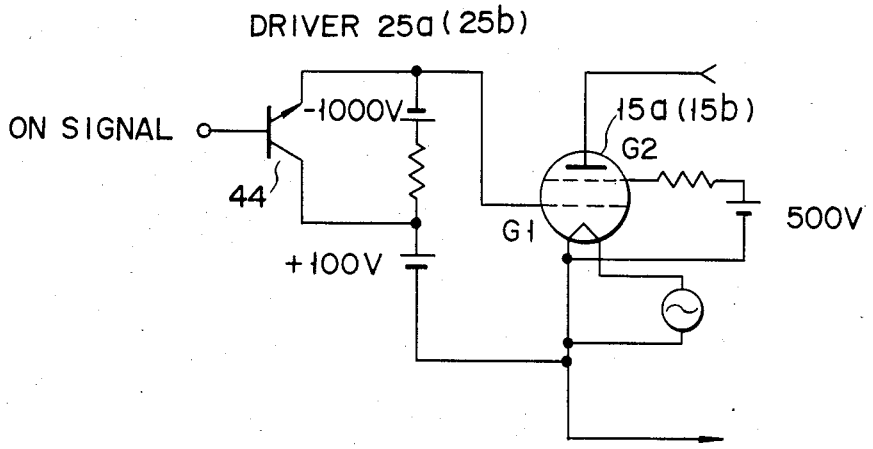
FIG. 3 is an arrangement of a driver for a tetrode tube of FIG. 1.

FIG. 3 shows the arrangement of high-tension switch drivers 25*a* and 25*b*. The aforementioned ON signal is applied to the base of transistor 44. With transistor 44 in the ON state, a grid G1 of the tetrode tube is biased to a level of +100 V in relation to a cathode K, and thus the tetrode tube is turned on. With transistor 44 in the OFF state, the grid G1 is biased to a level of −900 V in relation to the cathode K, thus turning off the tetrode tube. In order to enhance the voltage amplification of the tetrode tube, a grid G2 of the tetrode tube is biased to a level of +500 V in relation to the cathode K.

Figure 4:
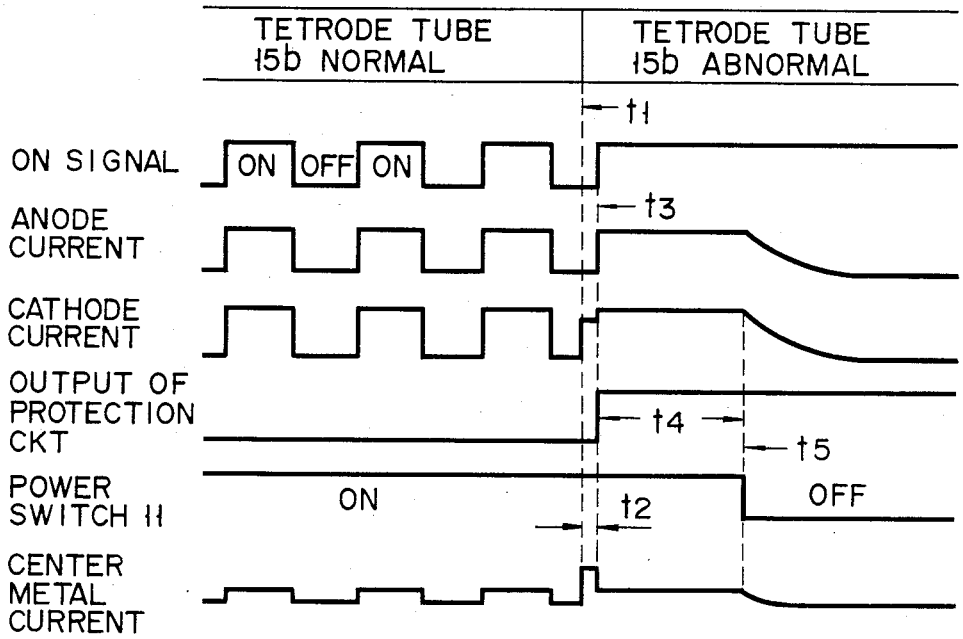
FIG. 4 is a timing chart for explaining the operation of the X-ray generator in FIG. 1.

FIG. 4 is a timing chart of when an abnormal control state of the X-rays for an X-ray CT (computed tomography) apparatus occurs. In this connection, it should be noted that the X-ray CT apparatus reconstitutes a slice of a human subject, by intermittently irradiating a human subject with X-rays, while rotating the X-ray tube around the subject, and detecting the X-rays which have been transmitted through the subject.

In FIG. 4, the ON signal is a high/low level repetitive pulse signal for irradiating the subject with X-rays. During the high-level period of the pulse, the high-tension switch is turned on, and a high voltage is applied across the anode and the cathode of the X-ray tube.

Where, at time t1 (an OFF timing if a normal state is involved), the high-tension switch malfunctions due to the occurrence of a short-circuiting fault, a larger-than-normal current flows through the center metal. Time t2 is the time taken for the high-tension switch to be forcedly short-circuited through the protection circuit and high-tension switch driver, after the aforementioned abnormal state has been detected by abnormal-current detection circuit 21. At this time, a current flowing through cathode 16b of the X-ray tube is smaller in level than normal, since switch 15a on the anode side is in the OFF state and thus, the applied voltage is one half the voltage when in the normal state. At time t3, a high voltage is applied across anode 16a and cathode 16b of X-ray tube 16, due to the forced short-circuiting of high-tension switch 15a, thereby emitting X-rays. Time t4 is the time required for the AC power-supply current to actually stop flowing through transformer 12, after protection circuit 22 has issued an interruption instruction to power source switch 11. This time is longer than time t2. Subsequent to time t5 et seq., the capacitors are discharged, and their discharge period is determined by the capacitance (for example 1 μF) of the capacitors and the resistance (for example, 50Ω) of resistors 17a and 17b.

By forcedly short-circuiting high-tension switch 15a, a current flowing through center metal electrode 16c flows during a momentary period of time t2 only. That time can be greatly shortened in comparison with time t1 to t5 conventionally required for power source switch 11 to be interrupted and the time required for the discharge to be ended.

Figure 2:
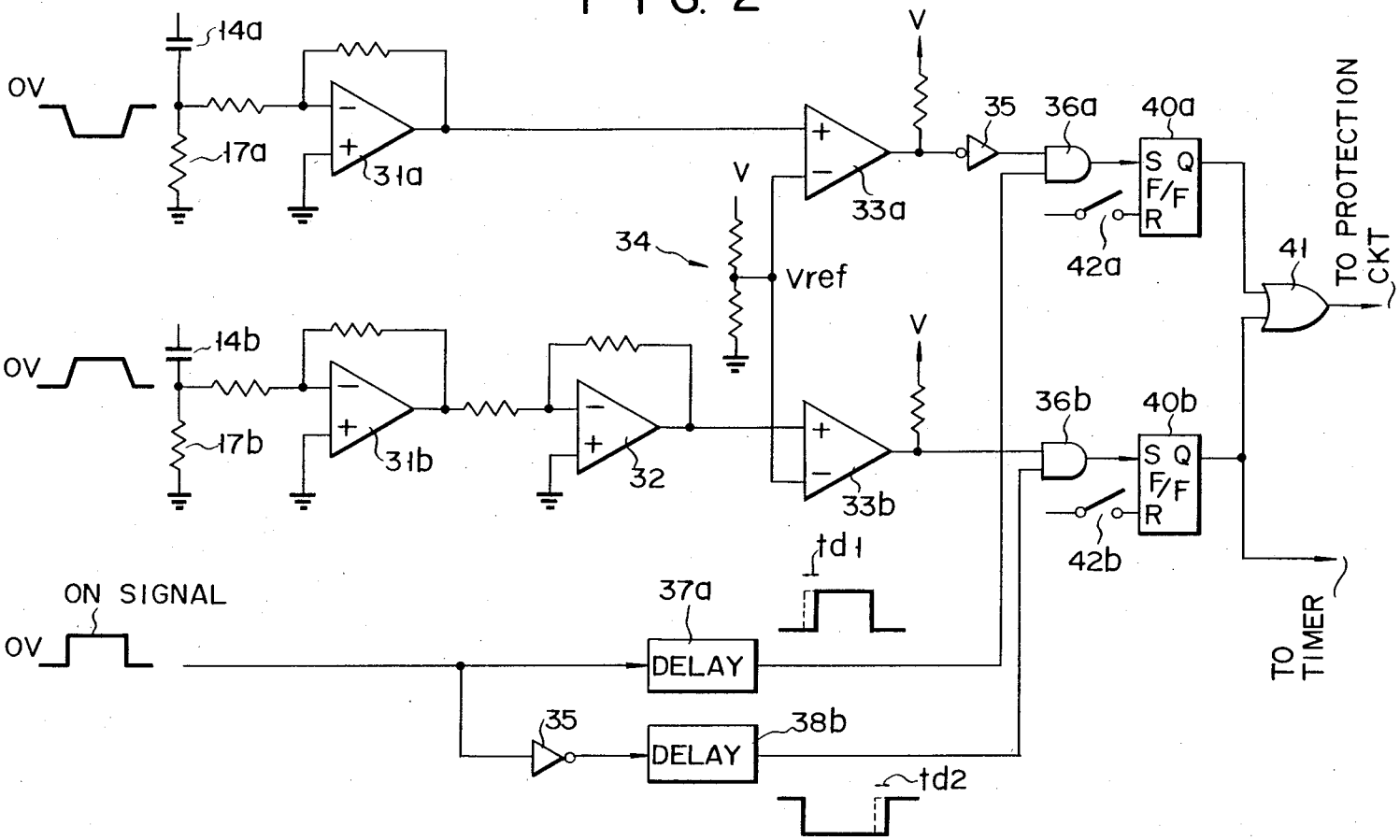
FIG. 2 is an arrangement of an abnormal-current detection circuit in FIG. 1.
Figure 5:
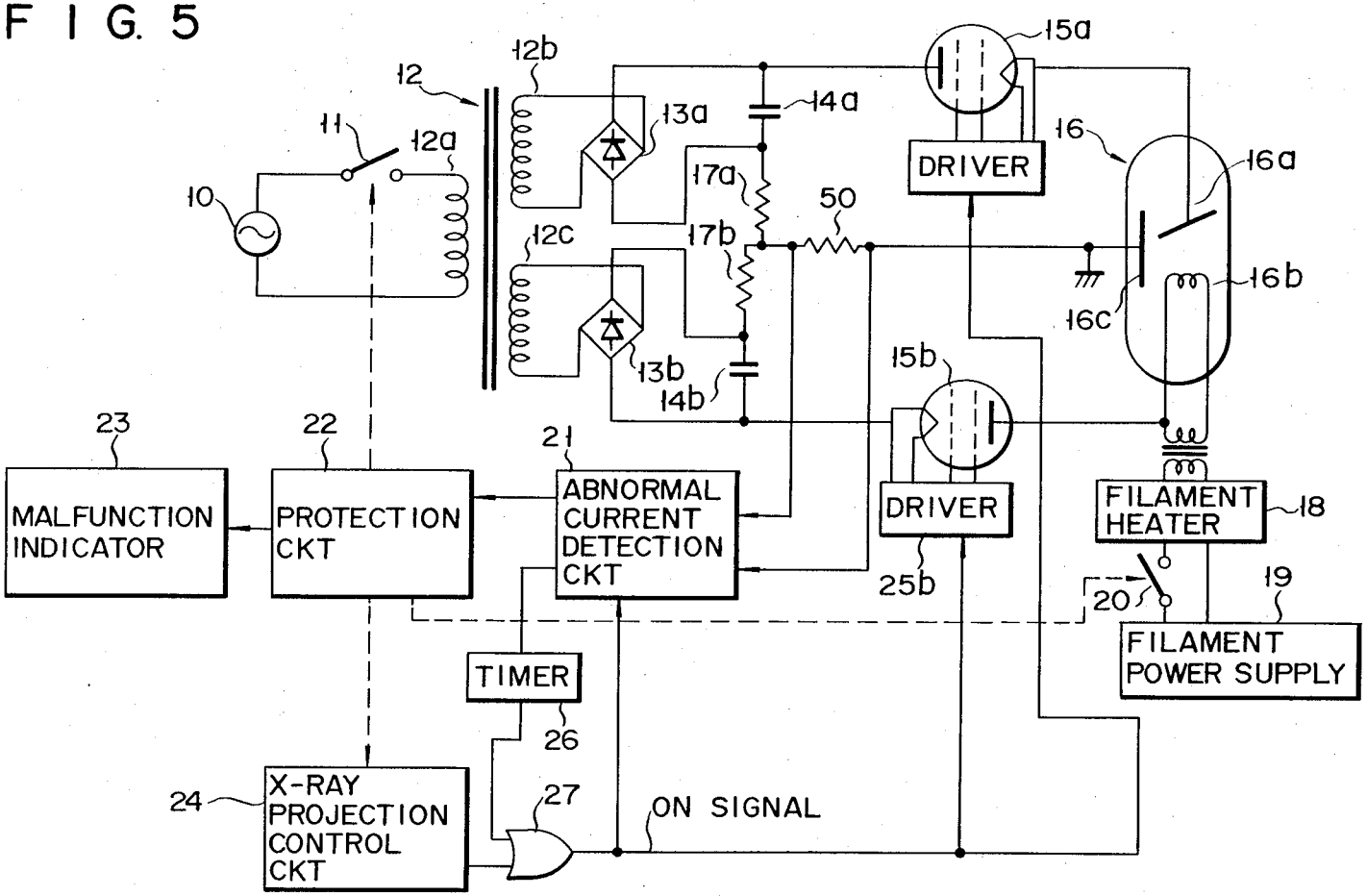
FIG. 5 is an arrangement of an X-ray generator according to a second embodiment of this invention.
Figure 7:
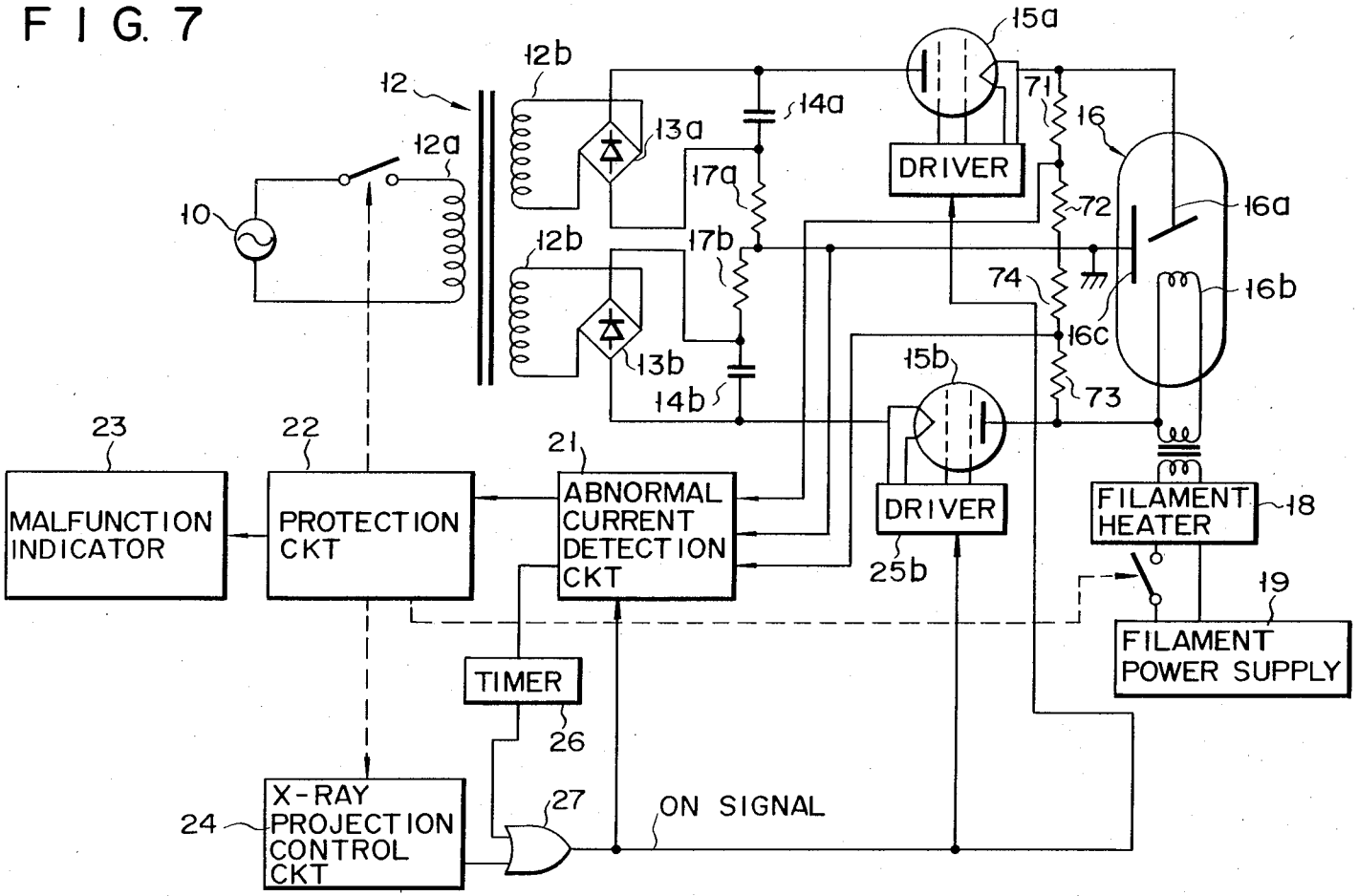
FIG. 7 is an arrangement of an X-ray generator according to a third embodiment of this invention.

FIGS. 5 and 7 show the second and third embodiments, in which identical reference numerals are employed to designate parts and elements having the same function as those in FIG. 2.

In the embodiment of FIG. 5, resistor 50, for center metal current detection, is connected between a connection point of resistors 17a and 17b and ground. A voltage across resistor 50 is measured by abnormal-current detection circuit 21, to detect any abnormal current flowing through center metal electrode 16c. Furthermore, it is possible to measure voltages produced across resistors 17a and 17b, by a detection circuit (not shown), and to simultaneously detect an abnormality on the anode side.

Figure 6:
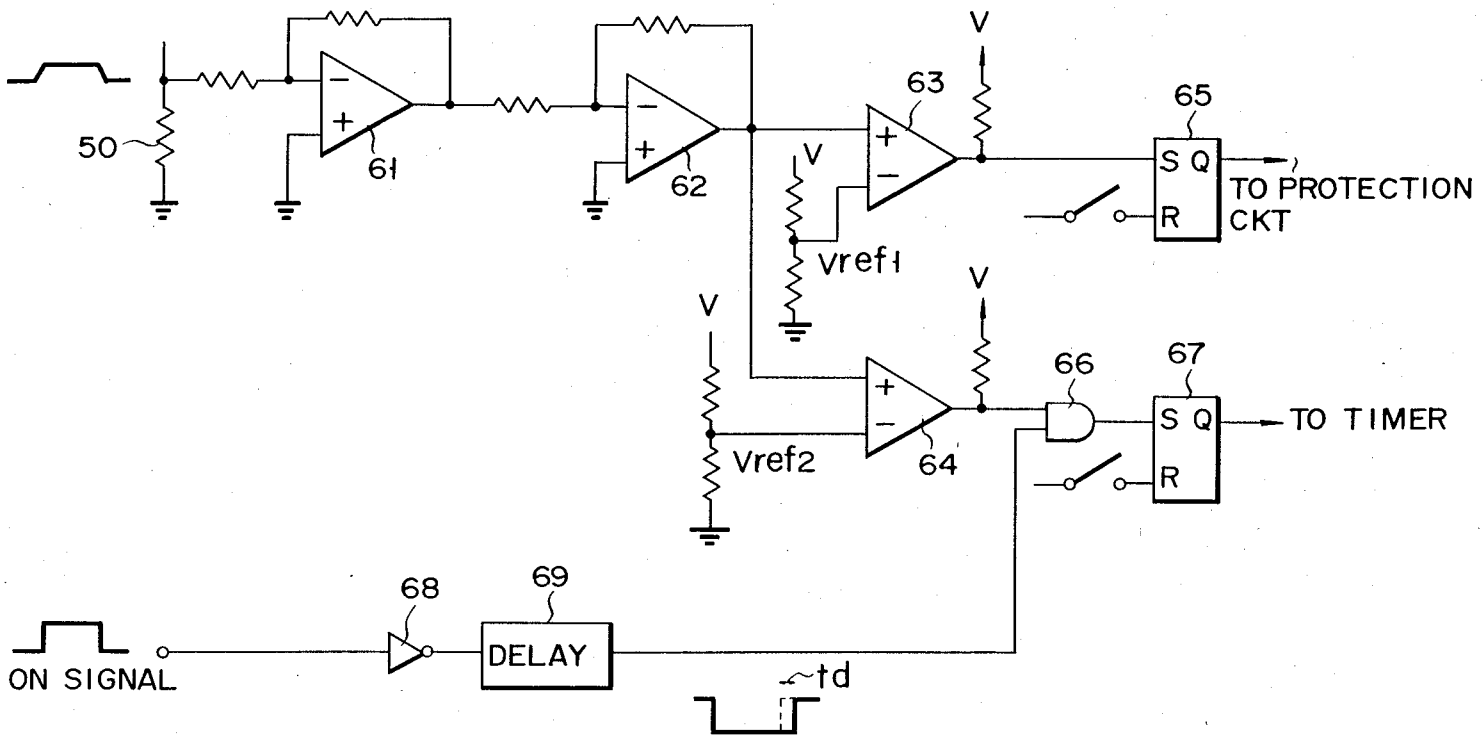
FIG. 6 is an arrangement of an abnormal-current detector in FIG. 5.

FIG. 6 is an arrangement of abnormal-current detection circuit 21 of the embodiment of FIG. 5. A voltage across resistor 50 is coupled, through a cascade connection of inverting amplifiers 61 and 62, to a noninverting input of comparator 63, where it is compared with a voltage Vref1 which is lower than a voltage produced across resistor 50 during an open-circuiting fault of tetrode tube 15a. On the other hand, a voltage across resistor 50 is coupled to a noninverting input of comparator 64, where it is compared with a voltage Vref2 which is lower than a voltage produced across resistor 50 during the short-circuiting fault of tetrode tube 15b connected to cathode 16b of X-ray tube 16. During the open-circuiting fault of tetrode tube 15a connected to anode 16a of X-ray tube 16, the output of comparator 63 goes high to allow flip-flop 65 to be set. On the other hand, the output of comparator 64 goes high during the short-circuiting fault. The output of comparator 64 is connected through AND gate 66 to a set input of flip-flop 67. The aforementioned ON signal is supplied via inverter 68 and delay circuit 69 to AND gate 66.

During the short-circuiting fault of tetrode tube 15b, the high-level output signal of comparator 64 is supplied through AND gate 66 to flip-flop 67, and thus, the flip-flop is set. The output Q of flip-flop 67 is supplied to timer 26, in the same way as set forth above.

In the embodiment of FIG. 7, an abnormal voltage, leaking during the switch fault, is detected by using a voltage divider connected across anode 16a and ground, and a voltage divider connected across cathode 16b and ground. Resistors 71 and 73 are of, for example, 470 μΩ, and resistors 72 and 74 are of, for example, 100 kΩ.

Figure 8:
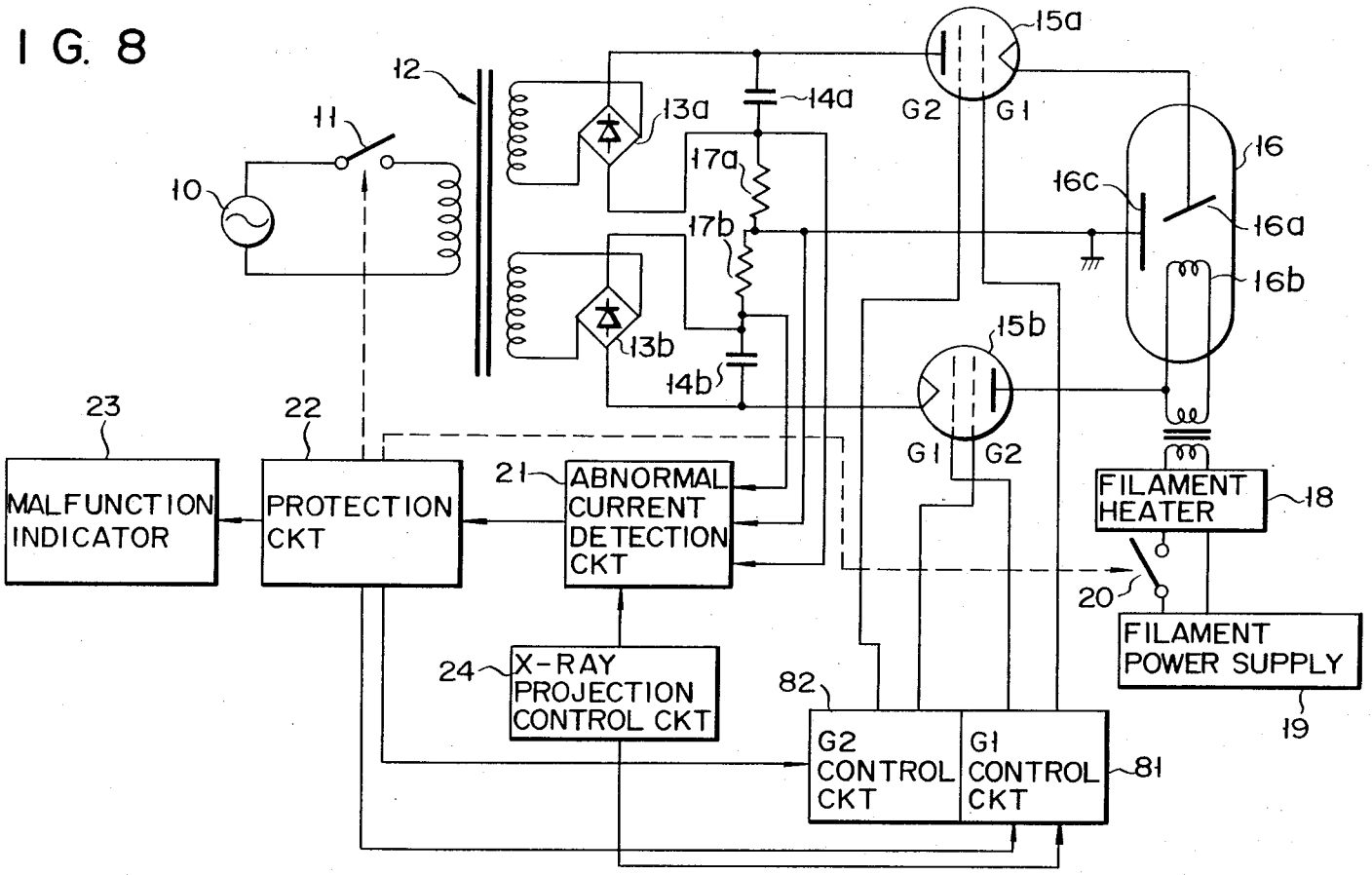
FIG. 8 is an arrangement of an X-ray generator according to a fourth embodiment of this invention.

FIG. 8 shows a fourth embodiment of this invention, in which identical reference numerals are employed to designate parts or elements corresponding to those shown in FIG. 1.

In the arrangement of FIG. 8, the ON-OFF switching controls of tetrode tubes 15a and 15b (high tension switches) are performed in a normal operation mode and abnormal-state detection mode. When tetrode tubes 15a and 15b operate in the normal mode, G1 control circuit 81 receives an X-ray projection control signal (ON signal) from X-ray projection control 24, and applies a voltage, positive (for example, +100 V) in relation to the cathode, to grids G1 of tetrode tubes 15a and 15b, causing these tetrode tubes to be substantially simultaneously switched on, so that a corresponding current flows through the X-ray tube for X-ray projection. On the other hand, when X-rays are not emitted for irradiation or projection, G1 control circuit 81 causes the tetrode tubes to be reverse-biased (for example, −900 V) with respect to their cathode. In the normal state, a voltage (for example, +500 V), normally positive in relation to the cathodes, is applied to grids G2 of the tetrode tubes. In the no-fault, normal mode, the tetrode tubes 15a and 15b are so controlled as to be substantially simultaneously switched on and off. Where grids G1 cannot be controlled, due to a fault in G1 control circuit 81, an abnormal current flows through X-ray tube 16, and a voltage different from that when in the normal mode, is applied to resistors 17a and 17b. Abnormal-current detection circuit 21 compares a voltage across resistor 17a with a voltage across resistor 17b, and judges whether or not the normal current flows in the X-ray tube. The abnormal-current detection circuit produces an abnormal-state signal when a coincidence occurs upon comparison. Upon receipt of this signal, protection circuit 22 immediately opens power source switch 11 and filament circuit switch 20 and, at the same time, issues a corresponding command to malfunction indicator 23 for error indication. Furthermore, protection circuit 22 also supplies an error-informing signal to G2 control circuit 82. G2 control circuit 82 supplies, upon receipt of this signal, a voltage, negative (for example, −900 V) in relation to the cathodes, to grids G2 of tetrode tubes 15a and 15b. That is, tetrode tubes are reverse-biased, in which case electrons emitted from the cathodes are repelled due to the negative voltage of the grid G2, thus failing to reach the anode. As a result, the current cannot be interrupted, even if a positive voltage is applied to grid G1.

This invention can be varied or modified in a variety of ways without departing from the spirit and scope of the invention.

Although, in the aforementioned embodiments, the detailed circuit arrangement for making such a required control has been explained by way of example, the required control may be performed through the utilization of, for example, software on a computer of a similar function.

Although the tetrode tubes have been explained as a high-tension switch, so as to control the grid G2, a similar control operation may be made, using the grids of five, or more, electrode tubes.

Although, in the aforementioned embodiments, the tetrode tubes are provided on the sides of the anode and cathode of the X-ray tube, a control operation may be performed, using a single tetrode tube for an X-ray tube with no center metal electrode.

What is claimed is:

1. An X-ray generator comprising:

an X-ray tube having an anode, cathode, and grounded center metal electrode;

a first high-voltage power source connected to said anode of said X-ray tube, to apply a positive high voltage to said anode of said X-ray tube;

a second high-voltage power source connected to said cathode of said X-ray tube, to apply a negative high voltage to said cathode of said X-ray tube;

first switching means connected between said first high-voltage power source and said anode of said X-ray tube;

second switching means connected between said second high-voltage power source and said cathode of said X-ray tube;

control-signal supply means connected to said first and second switching means, for supplying a control signal for simultaneously turning said first and second switching means on and off;

abnormal-current detection means connected to said first and second high-voltage power sources, for detecting an abnormal current flowing through said X-ray tube; and protection circuit means connected to said abnormal-current detection means, for causing at least the control signal supply means to stop the supply of the control signal to said first and second switching means, upon receipt of the detection of the abnormal current, the improvement wherein said abnormal-current detection means generates a short-circuiting fault detection signal indicative of a short-circuiting fault of said second switching means, in response to an abnormal current flowing through said center metal electrode of said X-ray tube, due to the short-circuiting fault of said second switching means, which fault may arise during an OFF period of said first and second switching means; and means is further provided for subsequently supplying a turn-on signal to at least said first switching means, in response to the short-circuiting fault detection signal from said abnormal-current detection means, to cause said first switching means to be turned on.

2. The X-ray generator according to claim 1, in which said first and second switching means are tetrode tubes.

3. The X-ray generator according to claim 1, in which said first high-voltage power source has a first smoothing capacitor and a first resistor connected between said first smoothing capacitor and said center metal electrode of said X-ray tube;

said second high-voltage power source has a second smoothing capacitor and a second resistor connected between said second smoothing capacitor and said center metal electrode of said X-ray tube; and said abnormal-current detection means is responsive to a voltage across said first resistor and a voltage across said second resistor, to detect the abnormal current of said X-ray tube.

4. The X-ray generator according to claim 1, in which a center metal electrode-current detection resistor is further provided, which is connected between said center metal electrode of said X-ray tube and a junction between said first and second power sources, to detect a current flowing through said center metal electrode; and said abnormal-current detection means detects the abnormal current of the X-ray tube, in response to a voltage across said center metal electrode-current detection resistor.

5. The X-ray generator according to claim 1, in which a first voltage divider is connected between said anode of said X-ray tube and said center metal electrode;

a second voltage divider is connected between said cathode of said X-ray tube and said center metal electrode; and said abnormal-current detection means detects the abnormal current of said X-ray tube, in response to output voltages of said first and second voltage dividers.

* * * * *